US011417962B2

(12) United States Patent
Parsche et al.

(10) Patent No.: US 11,417,962 B2
(45) Date of Patent: Aug. 16, 2022

(54) TOWER BASED ANTENNA INCLUDING MULTIPLE SETS OF ELONGATE ANTENNA ELEMENTS AND RELATED METHODS

(71) Applicant: EAGLE TECHNOLOGY, LLC, Melbourne, FL (US)

(72) Inventors: Francis Eugene Parsche, Palm Bay, FL (US); Matthew R. Samuelson, Bixby, OK (US); Emil G. Svatik, Micco, FL (US); Stephen B. Brown, Palm Bay, FL (US)

(73) Assignee: EAGLE TECHNOLOGY, LLC, Melbourne, FL (US)

( * ) Notice: Subject to any disclaimer, the term of this patent is extended or adjusted under 35 U.S.C. 154(b) by 177 days.

(21) Appl. No.: 17/021,204

(22) Filed: Sep. 15, 2020

(65) Prior Publication Data

US 2020/0411999 A1 Dec. 31, 2020

Related U.S. Application Data

(63) Continuation of application No. 15/980,857, filed on May 16, 2018, now Pat. No. 10,826,185.

(51) Int. Cl.
*H01Q 9/34* (2006.01)
*H01Q 9/36* (2006.01)
(Continued)

(52) U.S. Cl.
CPC ..... *H01Q 9/36* (2013.01); *H01Q 1/24* (2013.01); *H01Q 9/34* (2013.01); *H01Q 21/22* (2013.01)

(58) Field of Classification Search
CPC .. H01Q 9/36; H01Q 1/24; H01Q 9/34; H01Q 21/22
See application file for complete search history.

(56) References Cited

U.S. PATENT DOCUMENTS 3,234,948 A 2/1966 Stebbings
3,253,279 A 5/1966 Tanner
(Continued)

FOREIGN PATENT DOCUMENTS

JP 5624818 3/1981
WO 2017025675 2/2017

OTHER PUBLICATIONS

"Continental Electronics receives Patent Beneficial to Future eLoran Deployments" www.contelec.com; Dallas, Texas, Apr. 4, 2017; 1 pg. See Priority U.S. Appl. No. 15/980,857, filed May 16, 2018.
(Continued)

*Primary Examiner* — Dieu Hien T Duong
(74) *Attorney, Agent, or Firm* — Allen, Dyer, Doppelt + Gilchrist, P.A.

(57) ABSTRACT

An antenna may include a tower extending vertically upward from a ground location, a first set of elongate antenna elements extending outwardly from the tower at a first height above the ground location, and a second set of elongate antenna elements extending outwardly from the tower at a second height above the ground location and below the first height. In some embodiments, at least one elongate antenna element of the first and second sets of elongate antenna elements may be electrically coupled to the ground location. A radio frequency (RF) feed may be electrically coupled to the first and second sets of elongate antenna elements.

20 Claims, 6 Drawing Sheets

(51) Int. Cl.
*H01Q 1/24* (2006.01)
*H01Q 21/22* (2006.01)

(56) References Cited

U.S. PATENT DOCUMENTS

| | | | | |
|---|---|---|---|---|
| 3,419,873 | A | 12/1968 | Tanner et al. | |
| 3,742,511 | A | 6/1973 | Smith et al. | |
| 4,149,169 | A * | 4/1979 | Weber | H01Q 1/08 343/846 |
| 5,467,955 | A | 11/1995 | Beyersmith | |
| 6,873,300 | B2 | 3/2005 | Mendenhall | |
| 9,571,132 | B1 | 2/2017 | Hershberger | |
| 2009/0318094 | A1 | 12/2009 | Pros et al. | |

OTHER PUBLICATIONS

Martin Ehrenfried "The terminated coaxial cage monopol (tc2m) a new design of broadband HF vertical antenna" RadCom: May 2014, pp. 13-16. See Priority U.S. Appl. No. 15/980,857, filed May 16, 2018.

Martin Ehrenfried "A new design of broadband HF vertical antenna" RadCom: Jun. 2014, pp. 38-42. See Priority U.S. Appl. No. 15/980,857, filed May 16, 2018.

Sarah Mahmood "Critical Infrastructure Vulnerabilities to GPS Disruptions" http://www.gps.gov/governance/advisory/meetings/2014-06/mahmood.pdf, Jun. 4, 2014, pp. 17. See Priority U.S. Appl. No. 15/980,857, filed May 16, 2018.

Jansky & Bailey "The Loran-C system of navigation" http://www.loran-history.info/Loran-C/Jansky%20_%20Bailey%201962.pdf Feb. 1962, pp. 135. See Priority U.S. Appl. No. 15/980,857, filed May 16, 2018.

Anonymous "Loran-C" https://en.wikipedia.org/wiki/Loran-C#eLORAN; retrieved from internet Jan. 3, 2018; pp. 13. See Priority U.S. Appl. No. 15/980,857, filed May 16, 2018.

Koo et al. "Modified L-type eloran transmitting antenna for co-location with an AM antenna" 2016 International Symposium on Antennas and Propagation (ISAP); Abstract Only. See Priority U.S. Appl. No. 15/980,857, filed May 16, 2018.

Stout et al. "Designing, Developing, and Deploying a Small Footprint eLoran System" Proceedings of the 2010 International Technical Meeting of The Institute of Navigation Jan. 25-27, 2010; Abstract Only. See Priority U.S. Appl. No. 15/980,857, filed May 16, 2018.

Richard Degener "Loran navigation signal back on and better than before" Jun. 19, 2015 http://www.pressofatlanticcity.com/news/loran-navigation-signal-back-on-and-better-than-beforearticle_21d19298-16d0-11e5-9a69-1343edc2e90b.html, pp. 6. See Priority U.S. Appl. No. 15/980,857, filed May 16, 2018.

Chu, L.J. "Physical limitations of omni-directional antennas" Journal of Applied Physics 19: Dec. 1948; 1163-1175. Abstract Only. See Priority U.S. Appl. No. 15/980,857, filed May 16, 2018.

* cited by examiner

TOWER BASED ANTENNA INCLUDING MULTIPLE SETS OF ELONGATE ANTENNA ELEMENTS AND RELATED METHODS

TECHNICAL FIELD

The present invention relates to communications systems, and more particularly, to radio frequency (RF) antennas and related methods.

BACKGROUND

For communications in the Very Low Frequency (VLF), Low Frequency (LF), and Medium Frequency (MF) ranges, for example, relatively large ground-based antenna towers are used for transmitting such signals. Such antenna configurations may include a tower several hundred feet in height connected to the ground at its base, with numerous guy wires connecting the tower to ground for stability.

One example medium wave antenna system is disclosed in U.S. Pat. No. 6,873,300 to Mendenhall. This patent discloses an antenna system including an electrically conductive radiating mast that extends generally vertical relative to earth ground. The mast has a lower end for receiving RF energy for radiation thereby at an operating RF frequency and an upper end. A plurality of N radial, electrically conductive, wires are provided with each having an inner end and an outer end. The inner ends of the radial wires are electrically connected together and located proximate to the vertical mast. The radial wires are elevated throughout their lengths above the level of earth ground and extend radially outward from the vertical mast. A tuning device, such as an adjustable inductor, is connected to the radial wires for adjusting the impedance thereof such that the radial wires resonate at the operating frequency.

Another example where large scale tower based antennas are used is low frequency transmission stations for navigation systems, such as the long range navigation (LORAN) system. LORAN was developed in the United States during World War II. Subsequent implementations provided for enhancements in accuracy and usefulness, including LORAN-C and the later enhanced LORAN (eLoran) implementations. More particularly, eLoran is a low frequency radio navigation system that operates in the frequency band of 90 to 110 kHz. Low frequency eLoran transmissions can propagate by ground wave, a type of surface wave that hugs the earth. Ionospheric reflections or sky waves are another significant mechanism of eLoran wave propagation. With typical low frequency antennas, the tower itself is used as a monopole antenna. Because of the height of the tower, which may be 600 feet or more as a result of the operating wavelength, many upper wires connect to the tower top forming a resonating capacitor. These wires, known as top loading elements (TLEs), may approximate a solid cone.

eLoran may operate at low frequencies such as 100 kHz, making transmit antenna physical size large and yet antenna electrical size small relative to wavelength. Physics may limit electrically small antenna fixed tuned bandwidth. One theory is the Chu Limit as described in the reference "Physical limitations of omni-directional antennas", Chu, L. J. (December 1948), Journal of Applied Physics 19: 1163-1175, which is incorporated herein in its entirety by reference. The Chu Bandwidth Limit equation may $Q=1/kr^3$, where Q is a dimensionless number relating to bandwidth, k is the wave number$=2\pi/\lambda$, and r is the radius of a spherical analysis volume enclosing the antenna. Antenna radiation bandwidth is a matter of considerable importance to eLoran as it enables sharp eLoran pulses with fast rise times to be transmitted.

With the rise of satellite based navigations systems such as the Global Positioning System (GPS), there has been relatively little development or investment in terrestrial-based navigation systems such as eLoran until recently. A renewed interest in such systems has arisen as a backup to satellite navigation systems, particularly since low frequency eLoran signals are less susceptible to jamming or spoofing compared to the relatively higher frequency GPS signals. As such, further developments in eLoran antenna systems may be desirable in certain applications.

SUMMARY

An antenna may include a tower extending vertically upward from a ground location, a first set of elongate antenna elements extending outwardly from the tower at a first height above the ground location, and a second set of elongate antenna elements extending outwardly from the tower at a second height above the ground location and below the first height. The antenna may also include at least one elongate antenna element of the first and second sets of elongate antenna elements being electrically coupled to the ground location, and a radio frequency (RF) feed electrically coupled to the first and second sets of elongate antenna elements.

More particularly, the antenna may further include a plurality of buried ground conductors at the ground location, and the at least one elongate antenna element of the first and second sets of elongate antenna elements may be electrically coupled to the plurality of buried ground conductors. Moreover, the RF feed may also be electrically coupled to the plurality of buried ground conductors. Additionally, at least one of the first and second sets of elongate antenna elements may be arranged in a conical pattern. By way of example, the conical pattern may be defined by an angle from normal to the tower in a range of 10-90 degrees. In accordance with another example embodiment, at least one of the first and second sets of elongate antenna elements may be arranged in a planar pattern.

In accordance with an example implementation, the tower may comprise a conductive material, the first and second sets of elongate antenna elements may be electrically coupled to the tower, and the RF feed may be electrically coupled to the tower. In accordance with another example, the first and second sets of elongate antenna elements may be electrically insulated from the tower, and the antenna may further include an RF feed cable coupling the RF antenna feed to the first and second sets of elongate antenna elements.

By way of example, each of the first and second sets of elongate antenna elements may include at least ten elongate antenna elements. Furthermore, the first and second sets of elongate antenna elements may be configured to operate in the eLoran frequency range of 90 to 110 KHz, for example. Additionally, the tower may comprise a lattice tower in one example implementation.

A related method for making an antenna may include mounting a tower extending vertically upward from a ground location, mounting a first set of elongate antenna elements extending outwardly from the tower at a first height above the ground location, and mounting a second set of elongate antenna elements extending outwardly from the tower at a second height above the ground location and below the first height. The method may further include electrically coupling at least one elongate antenna element of the first and second sets of elongate antenna elements to the ground location, and electrically coupling a radio frequency (RF) feed to the first and second sets of elongate antenna elements.

DETAILED DESCRIPTION OF THE EMBODIMENTS

The present description is made with reference to the accompanying drawings, in which exemplary embodiments are shown. However, many different embodiments may be used, and thus the description should not be construed as limited to the particular embodiments set forth herein. Rather, these embodiments are provided so that this disclosure will be thorough and complete. Like numbers refer to like elements throughout, and prime notation and multiple prime notation are used to indicate similar elements in different embodiments.

Figure 1:
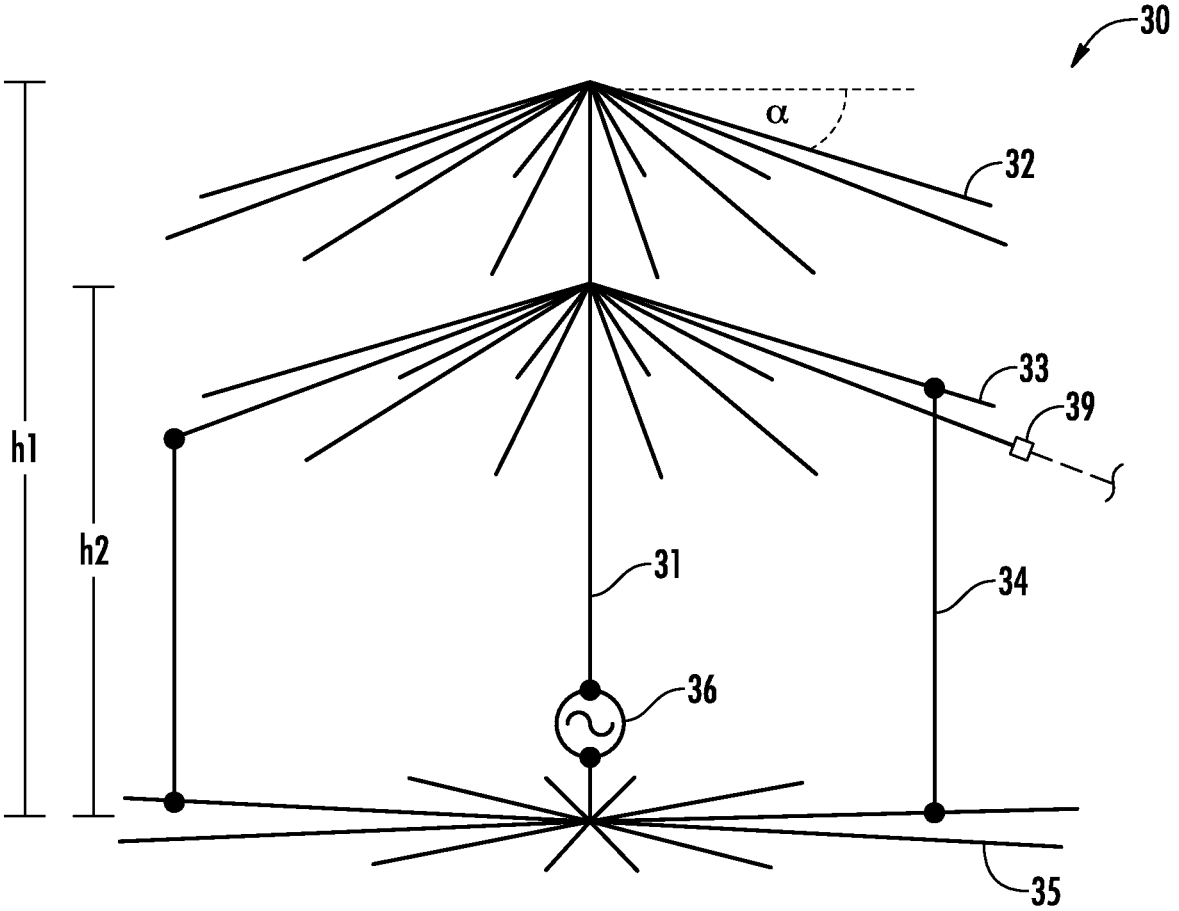
FIG. 1 is a schematic diagram of a tower-based antenna in accordance with an example embodiment including first and second sets of elongate antenna elements.

Referring initially to FIG. 1, an antenna 30 is first described which may be used for relatively low frequency applications, such as eLoran transmission stations. While the examples discussed herein are for eLoran installations, it will be appreciated that the various antenna configurations presented herein may also be used for other applications and frequency ranges (e.g., ULF, VLF, LF and MF such as Amplitude Modulation (AM) bands, etc.). Moreover, the antenna 30 may also be used for signal reception in some embodiments, although for the navigation application of eLoran the focus herein will be on signal transmission.

By way of background, the eLoran navigation system utilizes low frequency signal pulses in a range of 90 to 110 KHz. Moreover, eLoran pulses are interleaved, and the sharper the pulses the more eLoran stations that can be deployed. An eLoran transmit tower needs to transmit rise times in approximately 55 microseconds or less to reject skywave, and with peak powers which are typically 100 KW or higher. While increased antenna bandwidth increases reported position accuracy, it is desirable to avoid long antenna smeared pulses as they degrade system performance.

Furthermore, typical eLoran antennas included a ground-mounted conductive (e.g., metal) tower mounted on a base insulator. The tower itself was used as a monopole antenna. As noted above, upper wires connect to the tower top forming a resonating capacitor, and these top loading elements may approximate a solid cone. The top loading wires do not extend to the ground electrically due to insulators in the wires. However, this antenna configuration develops only a low radiation resistance, so a transformer and inductors are needed in a building at the tower base. Moreover, this type of conventional eLoran antenna configuration provides a quadratic frequency response.

eLoran transmit antennas may be electrically small relative to wavelength or nearly so. As such, eLoran antenna fixed tuned bandwidth may be limited according to the Chu-Harrington Limit of $1/kr^3$, where k is the wave number $2n/\lambda$ and r is the radius of an spherical analysis volume enclosing the antenna.

In the illustrated example, the antenna 30 includes a mast or tower 31 extending vertically upward from a ground location (schematically shown as a line in FIG. 1), and a first set of elongate antenna elements 32 extending outwardly from the tower at a first height h1 above the ground location. Furthermore, a second set of elongate antenna elements 33 extends outwardly from the tower at a second height h2 above the ground location and below the first height h1. Including two (or more) spaced apart sets of top loading elements as shown in the illustrated example advantageously increases the tuning order of the antenna 30, as will be discussed further below. By way of example, the antenna elements 32, 33 may be implemented using metal cables that extend down toward the ground which terminate at an insulator 39 (which may in turn be tied off to a ground anchor) or a shorter tower adjacent the main tower 31, as will be appreciated by those skilled in the art. Only one insulator 39 is shown in FIG. 1 for clarity of illustration.

Generally speaking, ten or more elements may be used in the first and second sets of elongate antenna elements 32, 33, and more particularly up to about thirty-six elements for an eLoran implementation. The tower 31 may be mounted on a base insulator (not shown).

In addition, the antenna 30 also illustratively includes one or more ground return conductors or cables 34 coupled to respective elongate antenna elements 33 so that they are electrically coupled to the ground location. More particularly, in the illustrated embodiment a plurality of buried ground conductors 35 (e.g., a cage) is provided at the ground location, and the ground return cables 34 couple respective antenna elements 33 to the ground conductors. The first and second sets of antenna elements 32, 33 are fed by a radio frequency (RF) feed source 36 which, in the illustrated example, is coupled to the tower 31. The RF feed source 36 is also electrically coupled to the ground conductors 35 as schematically shown in FIG. 1.

The ground return cables 34 advantageously increase tower resistance with respect to conventional eLoran antenna configurations. Furthermore, the more ground return cables 34 used, the higher the resistance. The ground return cables may be connected at different positions along the length of the antenna elements 33 (i.e., closer or further spaced from the tower 31). Generally speaking, the further the ground return cables 34 are out from the tower 31, the higher the resistance will be. This advantageously allows for direct impedance matching (e.g., 50 Ohm), so that no base transformer is needed as in conventional eLoran antenna configurations.

While the present approach is not bound to any particular theory of operation, the ground return cables 34 may carry antiparallel currents relative the tower 31. This means that that current flow in the ground return cables 34 may be in an opposite direction to the current flow on the tower 34. The opposite direction currents on the tower 31 and the ground return cables 34 in turn generate bucking induction fields to raise tower 31 base resistance. As well, in circuit equivalent terms the ground return cables 34 refer parallel inductance across the tower 31 base providing a method of raising antenna 30 driving resistance. Advantageously, the ground return cables 34 easily carry any high currents needed for large radio frequency (RF) feed source 36 power levels, and the ground return cables avoid the need for a transformer, helix or coil at the tower 31 base.

In accordance with an example implementation, the following steps may be performed: 1) sizing the first and second sets of antenna elements 32, 33 to place the antenna 30 slightly below resonance at the desired frequency of operating without the ground return cables 34 and then; 2) utilizing parallel inductance from the ground return cable(s) 34 to complete fine tuning for resonance at the desired frequency of operation.

In the illustrated example, both of the first and second sets of antenna elements 32, 33 are arranged in respective conical patterns. By way of example, the conical pattern may be defined by an angle $\alpha$ from normal to the tower in a range of 10-90 degrees, although both sets need not have the same angle. Furthermore, different antenna elements within the same set of elements may be at different angles relative to one another in some embodiments. Moreover, the angle $\alpha$ may be an upward angle for one or both sets of antenna elements 32, 33 in some embodiments, as opposed to the downward angle in the illustrated example. In accordance with one example eLoran implementation, the first height h1 may be approximately 650 feet, the second height h2 may be approximately 400 feet, and the first and second sets of antenna elements 32, 33 may extend laterally outward from the tower 31 approximately 300 feet. That is, the antenna may have a total width or "footprint" of about 600 feet (not including the grounding cage 35, which may extend wider than the antenna elements in some embodiments). Generally speaking, this footprint or diameter may be approximately 0.2-0.25 of the operating wavelength, for example.

Figure 2:
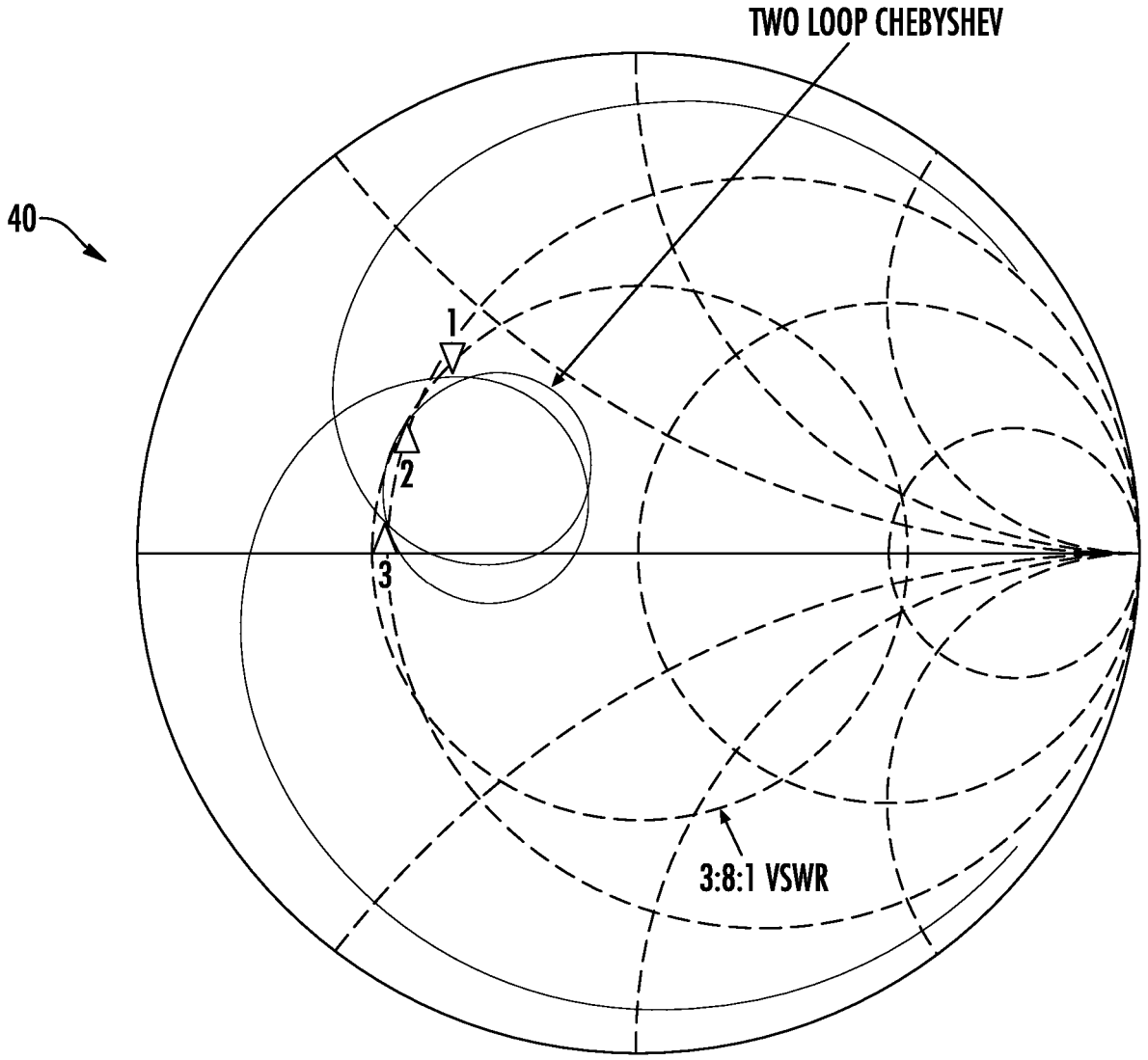
FIG. 2 is a diagram of measured driving impedance for a scale model implementation of the antenna of FIG. 1.
Figure 3:
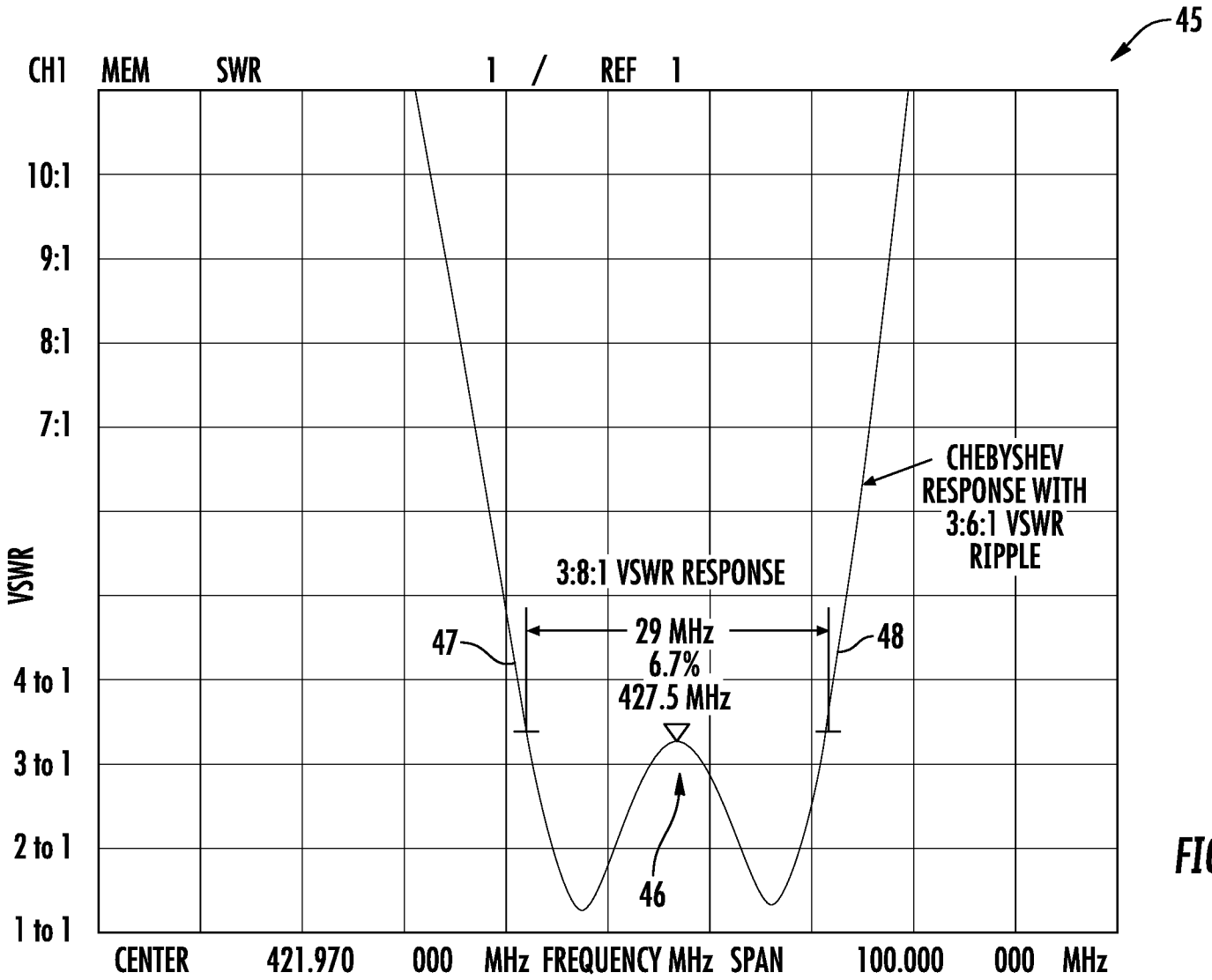
FIG. 3 is a diagram of measured VSWR response for the scale model implementation of the antenna of FIG. 1.

Based upon the above-noted eLoran antenna dimensions, a 3000:1 scale model was built and tested in a lab with a vector network analyzer using solid sheet metal cones emulating the wire cage configurations shown in FIG. 1, and the measurement results are shown the diagrams 40 and 45 of FIGS. 2 and 3. More particularly, measured vector driving impedance for the antenna is shown in the diagram 40 of FIG. 2 in Smith Chart format and the voltage standing wave ratio (VSWR) versus frequency is shown in diagram 45. In addition to providing a direct 50 Ohm match without the need for a base transformer, it may be observed that the example configuration also advantageously provides a two loop or $4^{th}$ order Chebyshev response as well, which is shown further in the diagram 45. More particularly, in the test configuration the Chebyshev double-tuned frequency response has a 3.4:1 VSWR center passband ripple 46 with a 29 MHz bandwidth centered at 427.5 MHz. Passband ripple amplitude 46 (VSWR at approximate midband) may be traded for realized bandwidth and VSWR level at the lower and upper passband edges, depicted as callouts 47 and 48 respectively. So, an increased VSWR at the passband center ripple 46 spreads the band edges 47 and 48 further apart, and lower VSWR at the passband center ripple 46 brings the band edges 47, 48 closer together. This is akin the behavior of a Chebyshev response filter so a two-dimensional matching area is created by trading the VSWR and bandwidth parameters. The spacing apart of the first and second sets of elongate antenna elements 32, 33 adjusts the bandwidth and ripple as well as the lengths of the first and second sets of elongate antenna elements 32, 33 relative each other. The antenna 30 may also be set up for a maximally flat response akin to Butterworth filters, where a minimal passband VSWR ripple is realized. Indeed, several filter response shapes may be practical. A form of Chu's limit equation for voltage standing wave ratio (VSWR) is 2:1 $VSWR \leq (70.7r/\lambda)^3$ where r is the radius of the enclosing sphere.

As can be appreciated, the simple monopole antenna or conventional top loaded monopole may have quadratic, single VSWR dip at first resonance. The Chu size-bandwidth limit appears to have been worked for quadratic response antennas and not multiple tuned antennas such as in the present examples. The present approach may advantageously allow for smaller eLoran transmitting antennas.

The antenna 30 is not limited as to the use of only two sets of elongate antenna elements 32, 33. Three and more sets of elongate antenna elements are theoretically possible. For example, the upper limit for tuning order and increased passband ripple rate from a large plurality of elongate antenna elements may be $3\pi$ that of a single set of elongate antenna elements 32. A single set of elongate antenna elements will for example produce a quadratic frequency response without further compensation. Of course, as diminishing return sets in regarding bandwidth as more and more sets of elongate antenna elements are employed and more passband ripples are realized.

Embodiments of the antenna 30 may include using only one set of elongate antenna elements 32 with the one or more ground return cables 34. This embodiment provides a quadratic frequency response and an adjustable driving resistance at the base of the tower 31 such as 50 ohms. The ground return cables 34 provide a method of adjusting or raising antenna tower 31 base resistance increase with any number of elongate antenna elements 32 or "capacitive hats", one or more.

Embodiments may also be used where two or more sets of elongate antenna elements may be used to obtain extended antenna 30 bandwidth without the use ground return cable(s) 34. In this embodiment, other approaches of adjusting or raising tower 30 base resistance may be employed, such as a common transformer with coil windings and an iron core (not shown), or a paralleled helix type inductor between the tower base and ground (not shown).

The realized gain response versus frequency of the antenna 30 may be approximately the reciprocal of the VSWR response versus frequency, although different amplitude scales will apply. Thus, where there is a VSWR minima the realized gain may be at maxima. The elevation plane radiation patterns of the antenna 30 is approximately the same sine function shape that a short monopole with a single set of elongate antenna elements 23 (not shown) exhibits, plus the ground effects. The radiation pattern bandwidth of antennas small versus wavelength antennas is quite stable over frequency, whereas impedance bandwidth may vary rapidly. The antenna 30 beneficially extends this impedance bandwidth. The realized gain of the antenna 30 is the product of directivity times efficiency. Efficiency depends upon factors including ground conductivity, which makes the number of ground conductors 35 important. For sufficiently conductive soils, estimates of directivity may be the small antenna directivity limit of 1.7 dBi with a 3 dBi directivity increase due to half space radiation, so 4.7 dB total. Radiation efficiency and realized gain may be computed for specific embodiments by the moment finite element methods using numerical computation.

The tuning of most to all low frequency antennas can drift over time, and this may include upward drifts in frequency due to soil freezing. Soil freezing reduces the soil relative permeability, and this reduces soil capacitive loading effects on a low frequency antennas. Low frequency antenna electric near fields (e.g. those of Gauss' Law) couple into any soil not shielded by the ground radial wire system. The antenna 30 may therefore be advantageous in areas subject to soil freezing and thawing, as the increased bandwidth can provide an increased margin against drift.

Figure 4:
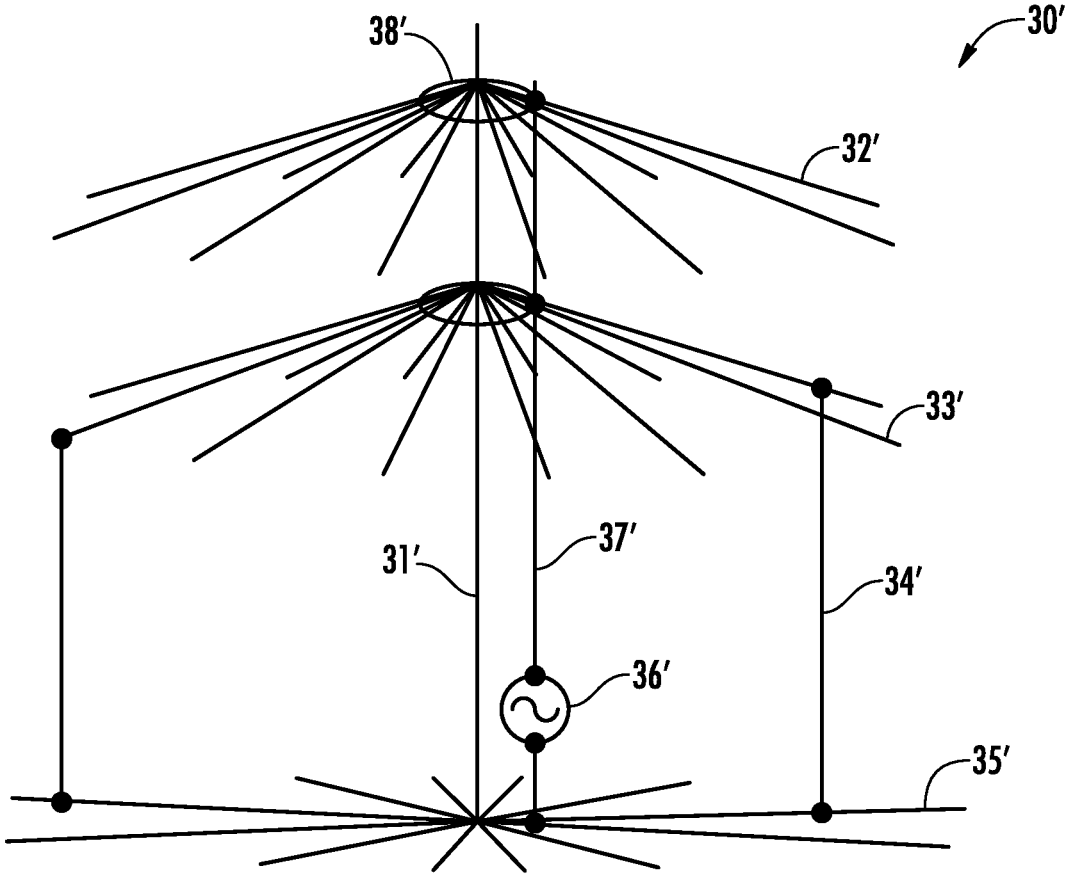
FIG. 4 is a schematic diagram of the tower-based antenna of FIG. 1 in accordance with an alternative embodiment.

In the example of FIG. 1, the first and second sets of elongate antenna elements 32, 33 are electrically coupled to the conductive tower 31, and the RF feed source 36 is also electrically coupled to the tower. Turning now to FIG. 4, in accordance with another example embodiment of the antenna 30', the first and second sets of elongate antenna elements 32', 33' may be electrically insulated from the tower 31', and the antenna may further include an RF feed cable 37' coupling the RF feed source 36' to the first and second sets of elongate antenna elements. More particularly, the first and second sets of antenna elements 32', 33' may be coupled to the tower 31 via respective insulators 38' (schematically illustrated as rings in FIG. 4). As a result, the tower 31' carries little to no electric current, and a base insulator may accordingly be omitted for this tower. This configuration may accordingly be advantageous in colder regions where ice may be problematic. The ground return cables 34' and ground conductors/cage 35' may be similar to those described above.

Figure 5:
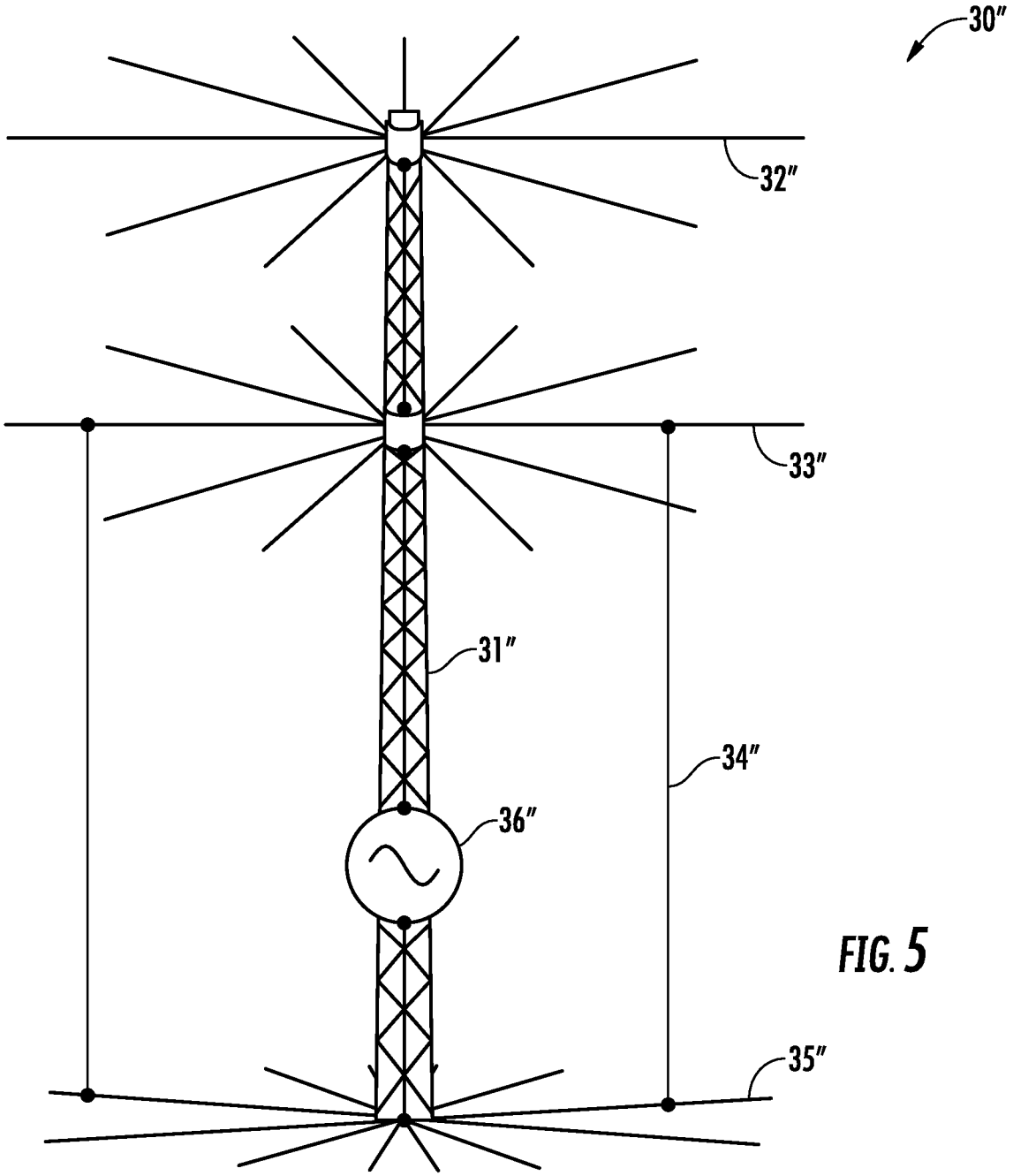
FIG. 5 is a schematic diagram of the tower-based antenna of FIG. 1 in accordance with still another embodiment.

In accordance with another example embodiment of the antenna 30" now described with reference to FIG. 5, one or both of the first and second sets of elongate antenna elements 32", 33" may be arranged in a planar pattern as shown, as opposed to the conical pattern described above. The tower 31' (which in the present example has a lattice framework), the RF signal source 36", ground return cables 34", and ground conductor 35" may be similar to those described above.

Figure 6:
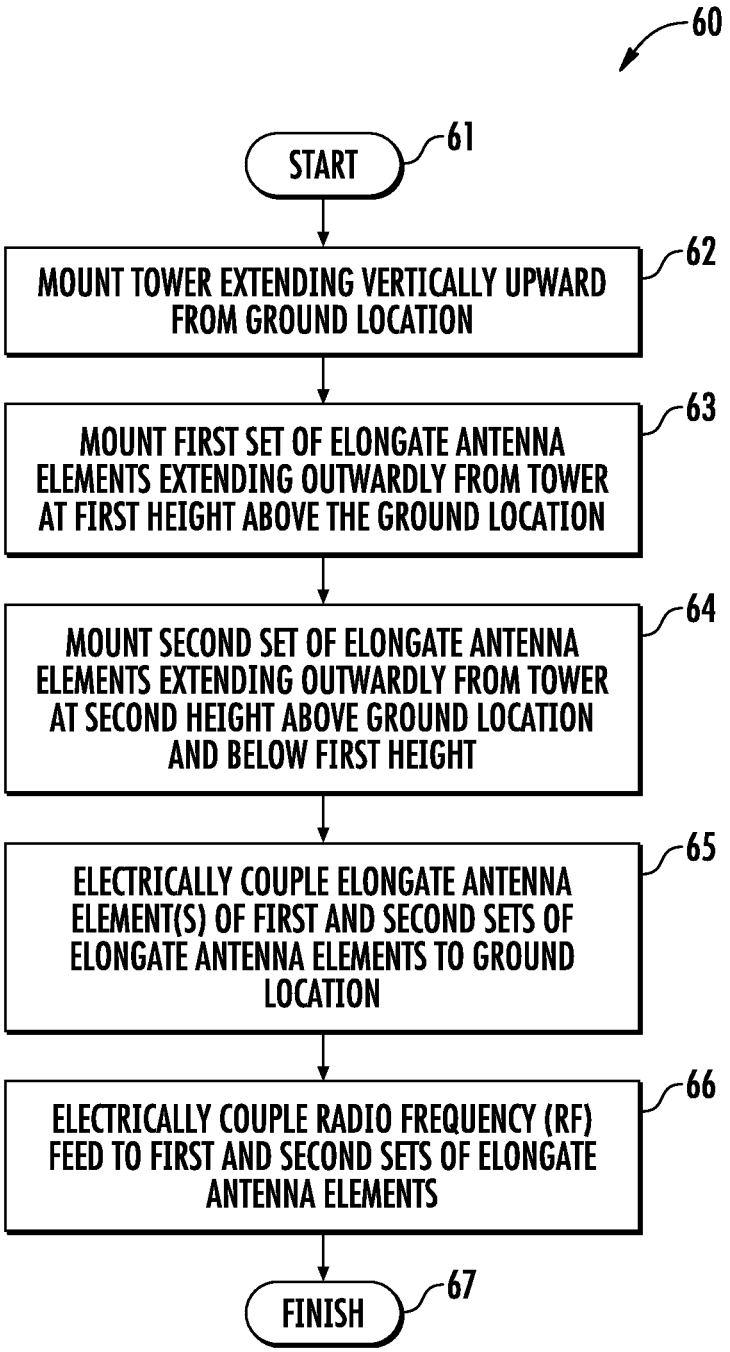
FIG. 6 is a flow diagram illustrating a method for making the antennas of FIGS. 1, 4 and 5.

A related method for making the antenna 30 (or the antennas 30', 30") is now described with reference to the flow diagram 60 of FIG. 6. The method begins at Block 61 with mounting the tower 31 extending vertically upward from a ground location (Block 62), and mounting the first set of elongate antenna elements 32 extending outwardly from the tower at a first height h1 above the ground location, at Block 63. The method further illustratively includes mounting the second set of elongate antenna elements extending outwardly from the tower 31 at a second height h2 above the ground location and below the first height h2, at Block 64. Furthermore, at least one elongate antenna element of the first and second sets of elongate antenna elements 32, 33 may be electrically coupled to the ground location, at Block 65. The method further illustratively includes electrically coupling the RF feed 36 to the first and second sets of elongate antenna elements, at Block 66, which concludes the method of FIG. 6 (Block 67). It should be noted that various steps may be performed in different orders in different embodiments (e.g., the first and second sets of antenna elements 32, 33 may be installed in different orders or at the same time).

Many modifications and other embodiments will come to the mind of one skilled in the art having the benefit of the teachings presented in the foregoing descriptions and the associated drawings. Therefore, it is understood that the disclosure is not to be limited to the specific embodiments disclosed, and that other modifications and embodiments are intended to be included within the scope of the appended claims.

That which is claimed is:

1. An antenna comprising:

a tower extending vertically upward from a ground location;

a first set of elongate antenna elements extending outwardly from the tower at a first height above the ground location and electrically insulated from the tower;

a second set of elongate antenna elements extending outwardly from the tower at a second height above the ground location and below the first height and electrically insulated from the tower; and a radio frequency (RF) feed cable extending along the tower and coupled to proximal ends of the first and second sets of elongate antenna elements adjacent the tower.

2. The antenna of claim 1 wherein at least one elongate antenna element of the first and second sets of elongate antenna elements is electrically coupled to the ground location.

3. The antenna of claim 2 further comprising a plurality of buried ground conductors at the ground location; and wherein the at least one elongate antenna element of the first and second sets of elongate antenna elements is electrically coupled to the plurality of buried ground conductors.

4. The antenna of claim 1 wherein at least one of the first and second sets of elongate antenna elements is arranged in a conical pattern.

5. The antenna of claim 4 wherein the conical pattern is defined by an angle from normal to the tower in a range of 10-90 degrees.

6. The antenna of claim 1 wherein at least one of the first and second sets of elongate antenna elements is arranged in a planar pattern.

7. The antenna of claim 1 wherein each of the first and second sets of elongate antenna elements comprises at least ten elongate antenna elements.

8. The antenna of claim 1 wherein the first and second sets of elongate antenna elements are configured to operate in the eLoran frequency range of 90 to 110 KHz.

9. The antenna of claim 1 wherein the tower comprises a lattice tower.

10. The antenna of claim 1 wherein the antenna defines a Chebyshev frequency response.

11. The antenna of claim 1 wherein the antenna defines a Butterworth passband response.

12. An antenna comprising:

a lattice tower extending vertically upward from a ground location;

a first set of elongate antenna elements extending outwardly from the lattice tower at a first height above the ground location and electrically insulated from the lattice tower;

a second set of elongate antenna elements extending outwardly from the lattice tower at a second height above the ground location and below the first height and electrically insulated from the lattice tower;

a radio frequency (RF) feed cable extending along the lattice tower and electrically coupled to proximal ends of the first and second sets of elongate antenna elements adjacent the lattice tower; and a plurality of buried ground conductors adjacent the lattice tower.

13. The antenna of claim 12 wherein at least one elongate antenna element of the first and second sets of elongate antenna elements is electrically coupled to the plurality of buried ground conductors.

14. The antenna of claim 12 wherein at least one of the first and second sets of elongate antenna elements is arranged in a conical pattern.

15. The antenna of claim 12 wherein the first and second sets of elongate antenna elements are configured to operate in the eLoran frequency range of 90 to 110 KHz.

16. A method for making an antenna comprising:

mounting a first set of elongate antenna elements extending outwardly from a tower at a first height above the ground location and electrically insulated from the tower;

mounting a second set of elongate antenna elements extending outwardly from the tower at a second height above the ground location and below the first height and electrically insulated from the tower; and mounting a radio frequency (RF) feed cable extending along the tower and electrically coupled in the RF feed cable to proximal ends of the first and second sets of elongate antenna elements adjacent the tower.

17. The method of claim 16 further comprising electrically coupling at least one elongate antenna element of the first and second sets of elongate antenna elements to a ground location beneath the tower.

18. The method of claim 16 wherein at least one of the first and second sets of elongate antenna elements is mounted in a conical pattern.

19. The method of claim 16 wherein at least one of the first and second sets of elongate antenna elements is mounted in a planar pattern.

20. The method of claim 16 wherein the first and second sets of elongate antenna elements are configured to operate in the eLoran frequency range of 90 to 110 KHz.

* * * * *